US005799356A

United States Patent [19]

Kawashima

[11] Patent Number: 5,799,356

[45] Date of Patent: Sep. 1, 1998

[54] TOOTH BRUSH

[75] Inventor: Yonesaburo Kawashima, Tochigi-ken, Japan

[73] Assignee: Tochigi Seiko Co., Ltd., Tochigi-Ken, Japan

[21] Appl. No.: 815,938

[22] Filed: Mar. 13, 1997

[30] Foreign Application Priority Data

Mar. 13, 1996 [JP] Japan ..... 8-002602

[51] Int. Cl.[6] ..... A46B 9/04

[52] U.S. Cl. ..... 15/167.1; 15/207.2

[58] Field of Search ..... 15/105, 167.1, 15/207.2

[56] References Cited

FOREIGN PATENT DOCUMENTS

| | | | |
|---|---|---|---|
| 2551663 | 3/1985 | France | 15/207.2 |
| 3430355 | 3/1985 | Germany | 15/167.1 |
| 4215706 | 8/1992 | Japan | 15/167.1 |
| 4123121 | 11/1992 | Japan | 15/167.1 |
| 2117230 | 10/1983 | United Kingdom | 15/207.2 |

*Primary Examiner*—Randall Chin

*Attorney, Agent, or Firm*—Wenderoth, Lind & Ponack, L.L.P.

[57] ABSTRACT

A tooth brush includes, in addition to bristles, a plurality of magnetic projections on a handle of the tooth brush for massaging gums, thereby preventing and remedying dental disease such as alveolysis, peris dentosis and the like. The magnetic projections are constituted of rod shaped synthetic resin members each having at a tip end thereof a permanent magnet member or piece. Each of the rod shaped members passes through the handle from a side thereof opposite the bristles and being secured to a common base plate on such side of the handle.

5 Claims, 1 Drawing Sheet

TOOTH BRUSH

BACKGROUND OF THE INVENTION

This invention relates generally to a tooth brush and particularly, to a tooth brush having a plurality of projections provided in addition to the bristles of the tooth brush for massaging gums in addition to cleaning teeth.

Japanese Utility Model Publication 62-30983 shows a tooth brush having a plurality of projections provided in addition to the bristles of the tooth brush for massaging gums. It is described that the projections include respective magnets which are particularly effective in preventing and remedying dental disease such as alveolysis, peris dentosis and the like.

The prior art projections having magnets are mounted on the handle of the tooth brush from the side of the handle having bristles. The mounting operation is relatively easy, but such mounting is not reliable and durability thereof is poor.

SUMMARY OF THE INVENTION

According to the present invention, there is provided a tooth brush having bristles and a plurality of magnetic projections on a handle of the tooth brush. The magnetic projections are constituted of rod shaped synthetic resin members each having at a tip end thereof a permanent magnet member piece. Each of the rod shaped members passes through the handle from the side thereof opposite the side having bristles. All of the rod shaped members are secured to a common base plate on the side of the handle opposite the side having the bristles. Each magnetic projection passes through a respective hole formed in the handle and, after passing through the handle all of the magnetic projections are secured to the common base plate.

Further objects and advantages of the invention will become apparent from the following detailed description of a preferred embodiment with reference to the drawings.

DETAILED DESCRIPTION OF THE PREFERRED EMBODIMENT

Figure 1:
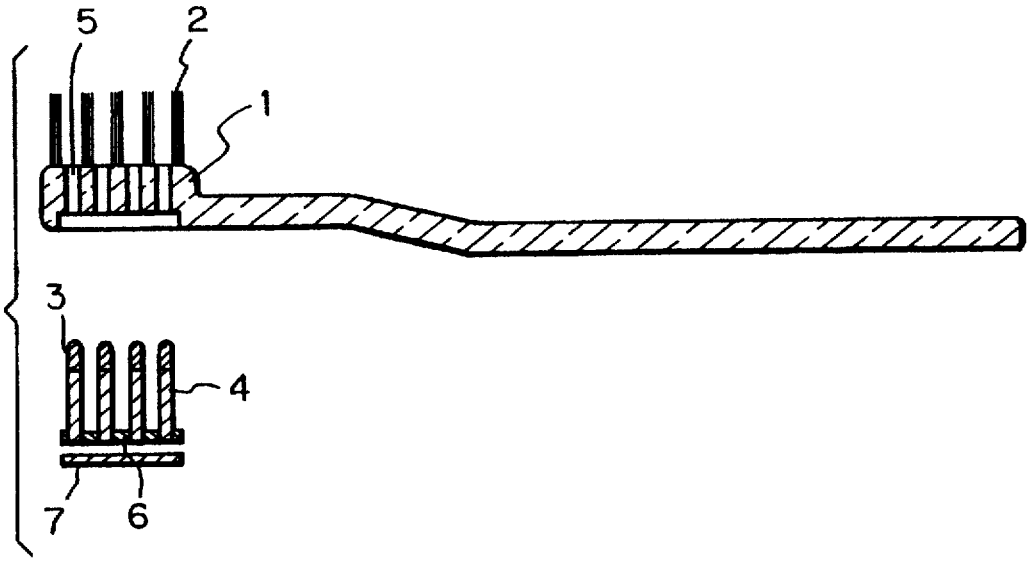
FIG. 1 is a schematic longitudinal sectional view of parts constituting a tooth brush according to a preferred embodiment of the present invention.
Figure 2:
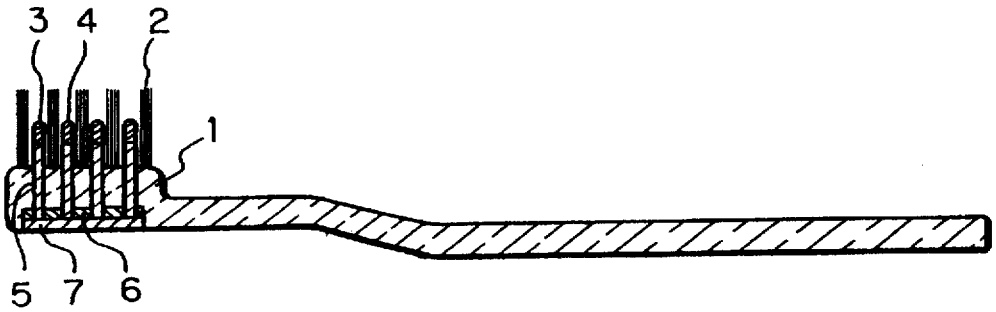
FIG. 2 is a schematic longitudinal sectional view of an assembled tooth brush according to the present invention.

In the drawings, shown at numeral 1 is a tip end portion of a handle of a tooth brush to which first ends of bristles 2 such as fur or nylon fibers formed in plural columns and rows are secured by a known method.

There are provided at least one row of spaced apart through holes 5 in the handle 1. When one row of holes 5 is provided, the row extends along the longitudinal center line (left and right directions in the drawing) of the handle. It is possible to provide two or more rows of holes 5.

Shown at 4 is a member formed of a synthetic resin material and having a plural number of rod shaped projections each having at a tip end thereof a rod shaped permanent magnet 3. The member 4 is mounted on the handle 1 with each of the projections passing through a respective hole 5. Thereafter, a base plate 7 is secured to the member 4 and to handle 1 on the side of the handle 1 not having bristles 2. The portions of the member 4 projecting from the handle 1 constitute the magnetic projections according to the invention.

As shown, the diameter of each permanent magnet 3 is substantially equal to the diameter of the respective rod shaped resin projection. Thus, each magnetic projection easily can be passed through the respective hole 5.

In the illustrated embodiment, the projections of the member 4 are connected together through a base portion 6, which simplifies production and mounting operations. However, it is possible to form rod shaped projections with permanent magnet pieces 3 incorporated therein and, after inserting respective projections through the holes 5, the base end portions of the projections are connected to the base plate 7. According to the invention, the magnetic projections are easily and reliably mounted on the tooth brush.

As shown, the tip ends of the magnetic projections extend from handle 1 by a distance approximately equal to one-half or slightly more than one-half of the height of bristles 2.

It will be understood that the invention is not limited to the illustrated embodiment, and that various changes and modifications can easily be made by those skilled in the art within the scope of the present invention as defined by the claims.

What is claimed is:

1. A tooth brush comprising:

a handle having opposite first and second sides and a plurality of holes extending through said handle from said first side to said second side;

bristles fixed to and extending from said first side thereof;

a plurality of magnetic projections extending through respective said holes from said second side of said handle to and beyond said first side thereof, said magnetic projections projecting from said first side of said handle by a distance equal to approximately one-half the height of said bristles;

each said magnetic projection including a rod shaped resin projection having at a tip end thereof a permanent magnet member, each said permanent magnet member having a diameter substantially equal to a diameter of the respective said resin projection; and a base plate secured to said second side of said handle and securing said magnetic projections in said handle.

2. A tooth brush as claimed in claim 1, wherein said base plate is secured to said resin projections.

3. A tooth brush as claimed in claim 1, further comprising a base portion connected to said resin projections at said second side of said handle, said base plate fitting over said base portion.

4. A tooth brush as claimed in claim 1, wherein said base plate fits in a recess formed in said second side of said handle.

5. A tooth brush as claimed in claim 1, wherein each said permanent magnet member is rod shaped.

* * * * *